US006971759B2

(12) United States Patent
Sutton

(10) Patent No.: US 6,971,759 B2
(45) Date of Patent: Dec. 6, 2005

(54) MULTIFUNCTION HYDRATION CONTAINER ACCESSORY

(76) Inventor: Brian Sutton, P.O. Box 5152, Ketchum, ID (US) 83333

( * ) Notice: Subject to any disclaimer, the term of this patent is extended or adjusted under 35 U.S.C. 154(b) by 0 days.

(21) Appl. No.: 10/667,569

(22) Filed: Sep. 19, 2003

(65) Prior Publication Data

US 2005/0063176 A1 Mar. 24, 2005

(51) Int. Cl.[7] ..... F21V 33/00
(52) U.S. Cl. ..... 362/101; 362/154; 362/473
(58) Field of Search ..... 362/101, 154, 362/473; 215/382–384, 386, 390, 392, 393, 215/395, 396; 220/475, 476, 480, 500, 503, 220/505, 507, 524, 735, 737, 741, 743

(56) References Cited

U.S. PATENT DOCUMENTS 4,071,175 A * 1/1978 Wagnon ..... 224/414
4,206,842 A * 6/1980 Burridge, Jr. ..... 206/459.1
4,886,567 A * 12/1989 Aidlin et al. ..... 156/423
6,158,870 A * 12/2000 Ramirez ..... 362/101
6,401,993 B1 * 6/2002 Andrino ..... 224/148.5
6,499,854 B2 * 12/2002 Chen ..... 362/101
6,817,192 B2 * 11/2004 Ector et al. ..... 62/125

* cited by examiner

*Primary Examiner*—John Anthony Ward
*Assistant Examiner*—Mark Tsidulko
(74) *Attorney, Agent, or Firm*—James E. Parris

(57) ABSTRACT

A multifunction hydration container accessory system having (comprising) a hydration container of generally cylindrical shape having a planar bottom surface with bottom edges and having a top for filling and dispensing hydration liquids and having (comprising) an accessory system housing of generally cylindrical shape having a first end for attaching to the hydration container planar bottom and having a second end for holding a plurality container accessories such as a compass, safety signal reflective material and container storage module.

25 Claims, 8 Drawing Sheets

MULTIFUNCTION HYDRATION CONTAINER ACCESSORY

FIELD OF INVENTION

This invention relates to a multifunction hydration container accessory and more particularly concerns a plurality of modules for attaching to hydration containers conventionally used in sports and activities such as bicycling, hiking and running, wherein the modules are configured for holding accessories such as direction indicators, altimeters, barometers, tools, food and the like while not impeding normal use of the hydration container.

BACKGROUND OF THE INVENTION

It is often times desirable to carry food, water and equipment while participating in outdoor activities such as running, biking and hiking. It is well known that consolidating and storing such items into convenient carrying cases is desirable. Some examples include bicycles, which are often equipped with racks and mounts to hold hydration containers and saddle bags, hikers often carry backpacks, and runners may carry a hand-held hydration bottle or use a hip pack, to name a few. It is also well known that water and hydration fluids are among the most desirable items to have readily accessible during recreation activities, wherein a hydration container is often configured for easy access and minimal impedance to the recreation activity, particularly during competition. Other desirable items considered useful include a compass, signal reflective material, cell phone, map or food items, where they are thought to be less desirable to have immediately accessible than hydrating fluids and are stowed in a carrying case. These carrying cases or cargo device are equipped with numerous zippers, straps and clips for opening and closing pockets and pouches, and when an item is desired for use, the user must access the carrying case by removing it from their back, waist or bicycle and search through the pack to locate the desired object. If the precise location of the desired item is not immediately known, the user must open numerous pockets and pouches until the item is located, causing delays and lending the user susceptible to inadvertently leaving one or more of the zippers, straps or clips open and unknowingly lose valuable contents within the carrying cases or carrying packs.

It is well know that endurance athletes today participate in several sporting categories in a single event. Specifically, an endurance event can include hiking, running, biking, kayaking and mountaineering over hundreds of miles over several days. Athletes are tested on their ability to race across great distances and difficult terrains, and their ability to negotiate a wilderness course using maps and compasses. In endurance events, efficiency is of paramount importance to placing a competitive finishing time, thus having desired items readily accessible for when they are needed is an important element for endurance athletes during training and competition. Specifically, it is desirable to have sporting accessories readily available for use, without having to remove and open packs and carrying cases to access desired objects.

DETAILED DESCRIPTION OF PREFERRED EMBODIMENT

Figure 1:
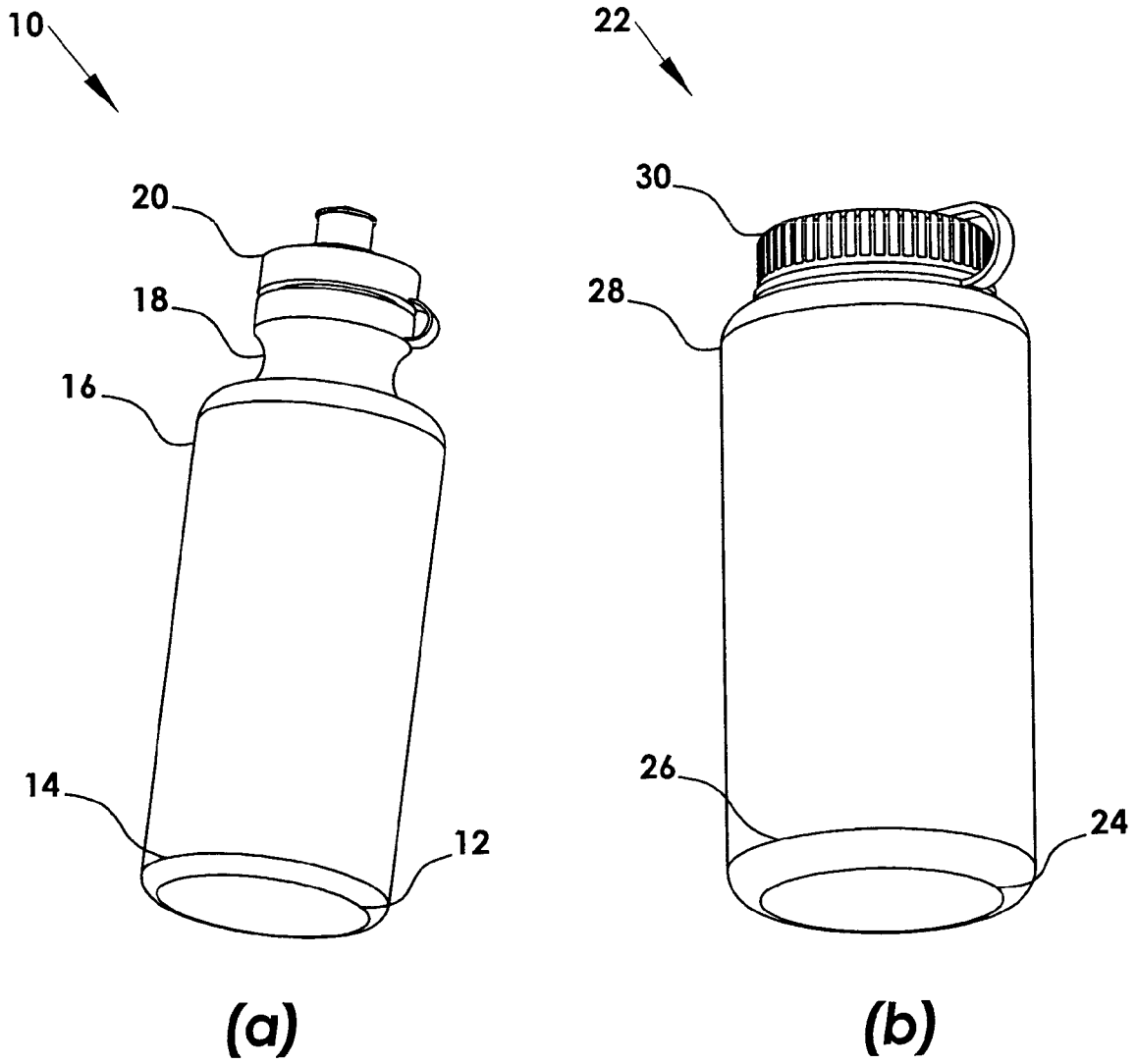
FIG. 1*a* and FIG. 1*b* Depict typical hydration containers.

As shown in the drawings for purpose illustration, the present invention is concerned with hydration container accessory devices. FIG. 1 depicts some typical hydration containers, where FIG. 1*a* depicts a hydration container typically used during athletic activities, such as bicycling and running, and FIG. 1*b* depicts a hydration container used during athletic activities such as hiking, camping and backpacking. For the purpose of discussion, the hydration container depicted in FIG. 1*a* shall be referred to as a bicycle hydration container 10, and the hydration container depicted in FIG. 1*b* shall be referred to as a hiking hydration container 22, where it is understood that other hydration containers having various shapes such as polygons and custom molded shapes could be used without departing from the spirit of the invention. Referring now to the bicycle hydration container 10 depicted in FIG. 1*a*, where the container is of generally cylindrical shape having a bicycle container bottom surface 12 with bicycle container bottom edges 14, bicycle a container body 16 for holding liquids, a bicycle container neck 18 for frictionally fitting into a bicycle hydration container cage (see FIG.'S 12*a* and 12*b*) and bicycle container top 20 for filling and dispensing liquids. FIG. 1*b* depicts a hiking hydration container 22 having a hiking container bottom surface 24 with hiking container bottom edges 26, a hiking container body 28 for holding liquids, a hiking container top 30 for filling and dispensing liquids.

Figure 2:
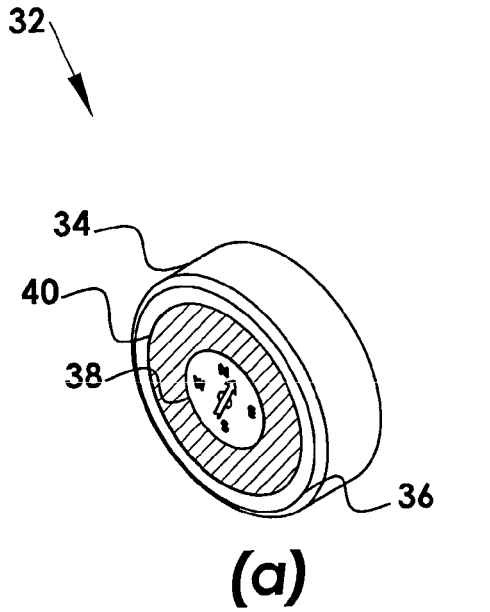
FIG. 2*a* and FIG. 2*b* Depict a bicycle hydration container accessory.
Figure 2:
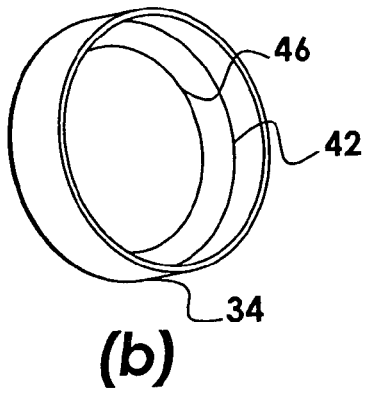

FIGS. 2*a*, 2*b*, depict perspective views of a multifunction hydration container accessory 32, suitable for attaching to the bicycle hydration container depicted in FIG. 1*a*, where FIG. 2*a* shows the front side of the bicycle multifunction hydration container accessory 32. In FIG. 2*a*, the bicycle multifunction hydration container accessory is depicted having an accessory housing 34, an accessory housing front 36 for fixedly mounting a compass 38 and safety signal reflective material 40 thereto, where it is understood that other useful items may be integrated to the housing front 36 such as a clock, global positioning system, altimeter, barometer, cell phone or safety noise-making device among others without departing from the spirit of the invention. FIG. 2*b* depicts the backside of the bicycle hydration container accessory 32 where the bicycle accessory housing 34 includes an inside bicycle accessory housing wall 42 and a bicycle accessory mounting surface 46, where the backside of the bicycle hydration container accessory 32 is contoured to receive the bicycle hydration container bottom surface 12, bicycle hydration container edges 14 and lower portion of the bicycle hydration container body 16, for fixedly mounting thereto using suitable bonding agents.

Figure 3:
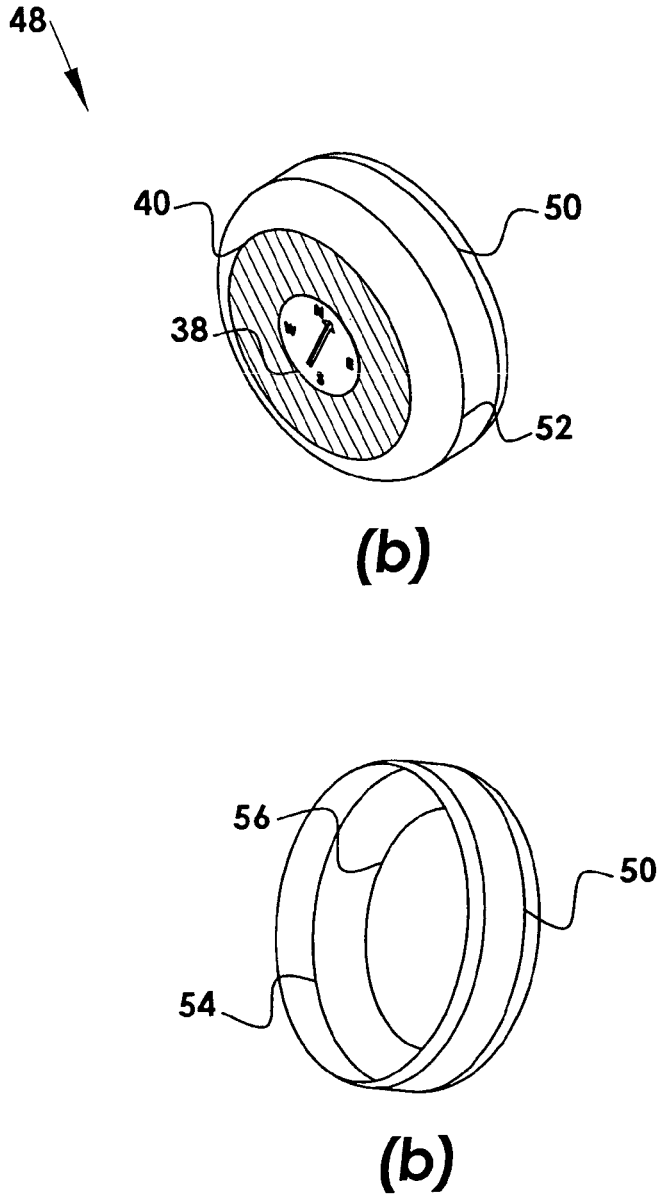
FIG. 3*a* and FIG. 3*b* Depict a hiking hydration container accessory.

FIGS. 3*a* and 3*b*, depict perspective views of a multifunction hiking hydration container accessory 48, suitable for attaching to the hiking hydration container depicted in FIG. 1*b*, where FIG. 3*a* shows the front side of the multifunction hiking hydration container accessory 48. In FIG. 3*a*, the multifunction hiking hydration container accessory is depicted having a hiking accessory housing 50, a hiking accessory housing front 52 for fixedly mounting a compass 38 and safety signal reflective material 40 thereto, where it is understood that other useful items may be integrated to the hiking housing front 52 such as a clock, global positioning system, altimeter, barometer, cell phone or safety noise-making device among others without departing from the spirit of the invention. FIG. 3*b* depicts the backside of the hiking hydration container accessory 48 where the hiking accessory housing 50 includes an hiking accessory inside housing wall 54 and a mounting surface 56, where the backside of the hiking hydration container accessory 48 is contoured to receive the hiking hydration container bottom surface 24, hiking hydration container edges 26 and lower portion of the hiking hydration container body 28, for fixedly mounting thereto using suitable bonding agents.

Figure 4:
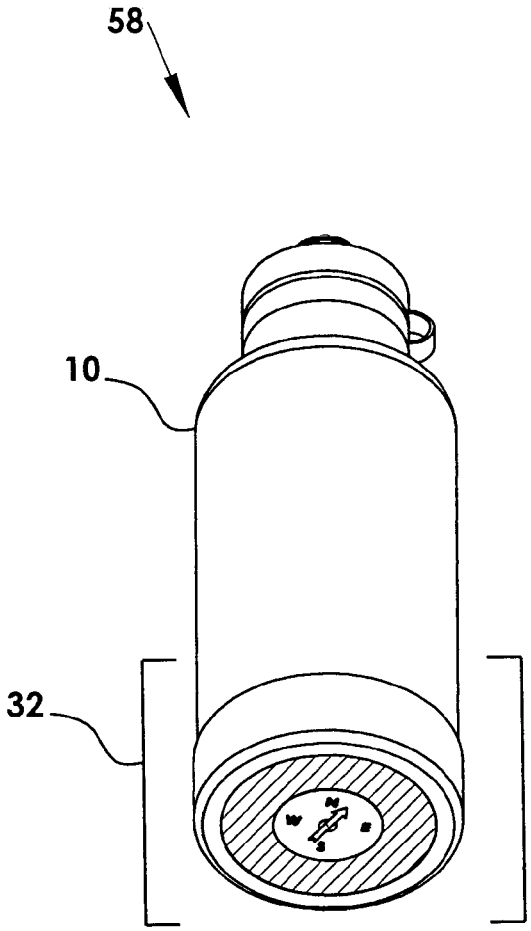
FIG. 4 Depicts a bicycle hydration container accessory system.

FIG. 4 depicts a bicycle multifunction hydration container accessory system 58 comprising a bicycle hydration container 10 fixedly attached to a hydration container accessory 32, where the bicycle hydration container bottom surface 12 and lower portion of bicycle container body 16 of FIG. 1*a* are fixedly attached to bicycle hydration accessory mounting surface 46 and inside housing wall 42 of FIG. 2*b* using a suitable bonding means such as adhesives, plastic welding, hook and pile or frictional and strapping means.

Figure 5:
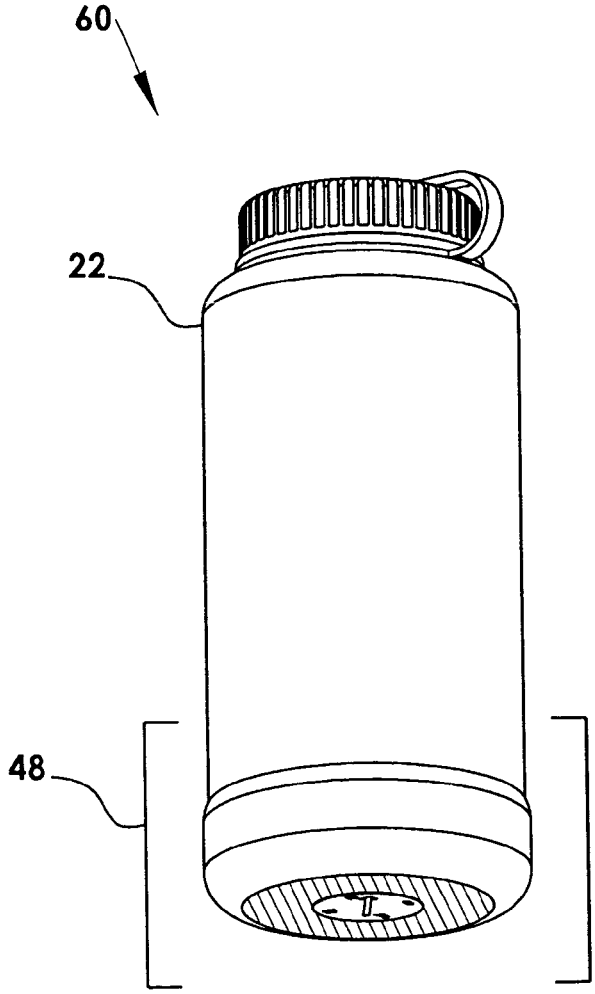
FIG. 5 Depicts a hiking hydration container accessory system.

FIG. 5 depicts a hiking multifunction hydration container accessory system 60 comprising a hiking hydration container 22 fixedly attached to a hiking hydration container accessory 48, where the hiking hydration container bottom surface 24, hiking hydration container edge 26 and lower portion of hiking container body 28 of FIG. 1*b* are fixedly attached to hiking hydration accessory mounting surface 56 and inside housing wall 54 of FIG. 3*b* using a suitable bonding means such as adhesives, plastic welding, hook and pile, or frictional and strapping means.

Figure 6:
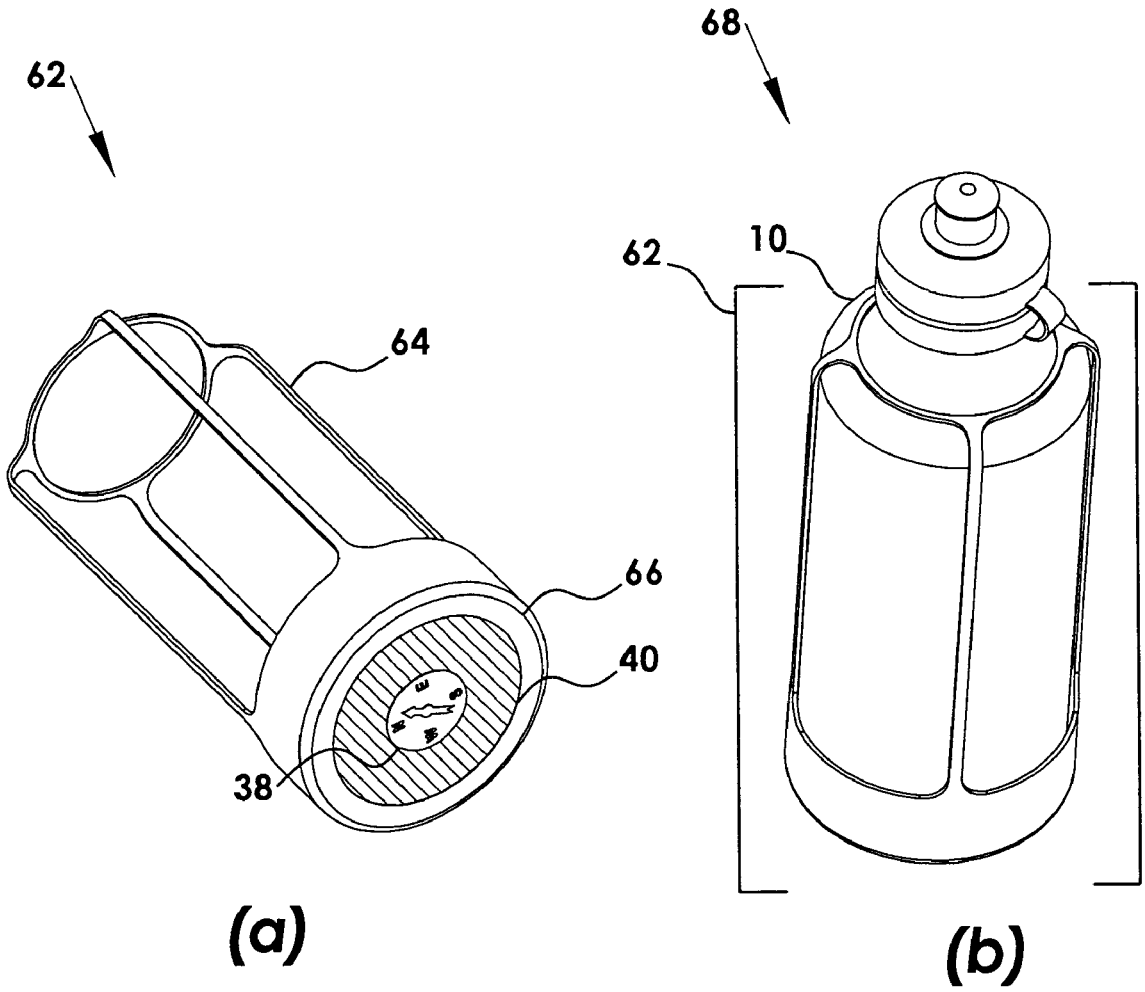
FIG. 6*a* and FIG. 6*b* Depict an alternative embodiment of a multifunction hydration container accessory system having strap on attachment means.

FIGS. 6*a* and 6*b* depict an alternative embodiment of the current invention, where shown in FIG. 6*a* is a strap on hydration container accessory 62 having elastic securing straps 64 for securing the hydration container accessory 62 to a hydration container. As depicted, FIG. 6*a* shows the strap on hydration accessory 62 having a strap on front surface 66 for fixedly attaching a compass 38 and a safety signal reflective material 40, where it is understood that other accessories may be included without departing from the spirit of the invention. FIG. 6*b* depicts a strap on hydration container accessory system 68 were depicted is the strap on hydration accessory 62 attached to a bicycle hydration container 10, where it is understood that the strap on hydration accessory 62 could be configured for a variety of hydration container shapes and sizes without departing from the spirit of the invention.

Figure 7:
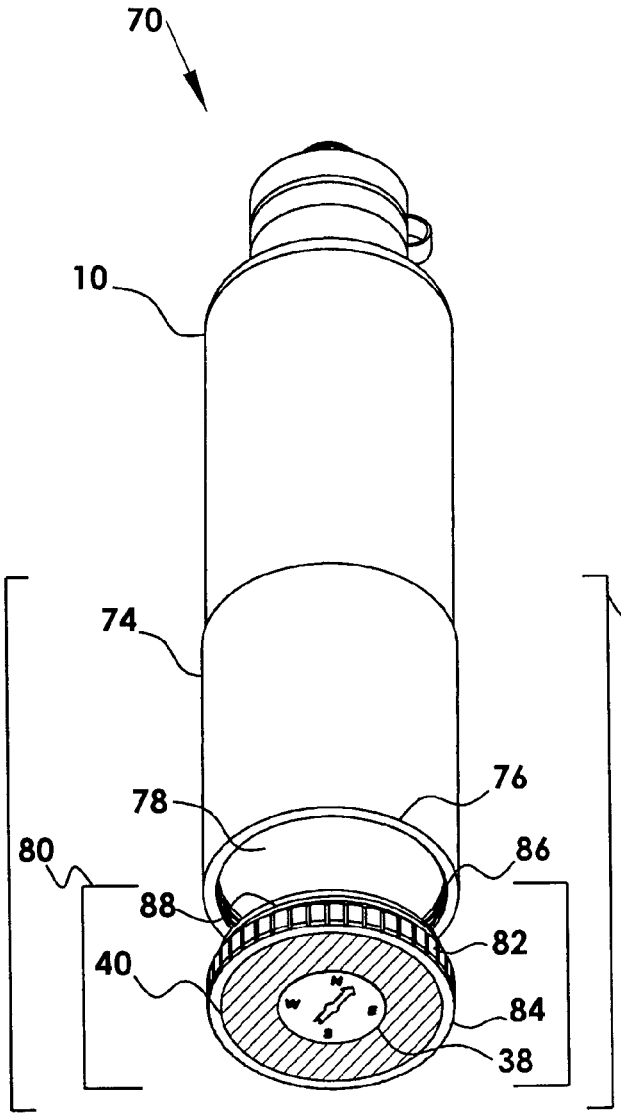
FIG. 7 Depicts an alternative embodiment of a multifunction hydration container accessory system having a mounted auxiliary container and a screw-on cap having a direction indicator accessory and a safety reflector reflective material accessory.

FIG. 7 depicts a partially exploded perspective view of an alternative embodiment of the invention, where shown is a multifunction canister storage hydration container accessory system 70 having a canister accessory 72 fixedly mounted to hydration container 10, where canister accessory 72 has a canister housing 74 with a mounting surface (not shown) as described with FIGS. 2*a* and 2*b*. Additionally, canister accessory 72 comprises canister walls 76 to create a canister cavity 78 for conveniently holding desired objects, and further comprises a canister cap 80 having a canister cap housing 82, a canister cap front surface 84 for fixedly mounting utility items such as a compass 38 and a safety signal reflective material 40. The canister walls 76 have canister female threads 86 for receiving canister cap male threads 88 to seal the canister cavity 78, where the depicted canister cap 80 is removed from the canister cavity 78 and canister female threads 86 for illustrative purposes. Here, male-female thread attachment is understood to include peg and groove assembly, post and slot configurations or the like without departing from the spirit of the invention. Further, it is obvious the canister cap front surface 84 could incorporate other accessories beyond the compass 38 such as a lighting source, a safety road reflector or a strobe beacon, to name a few without detracting from the spirit of the invention.

Figure 8:
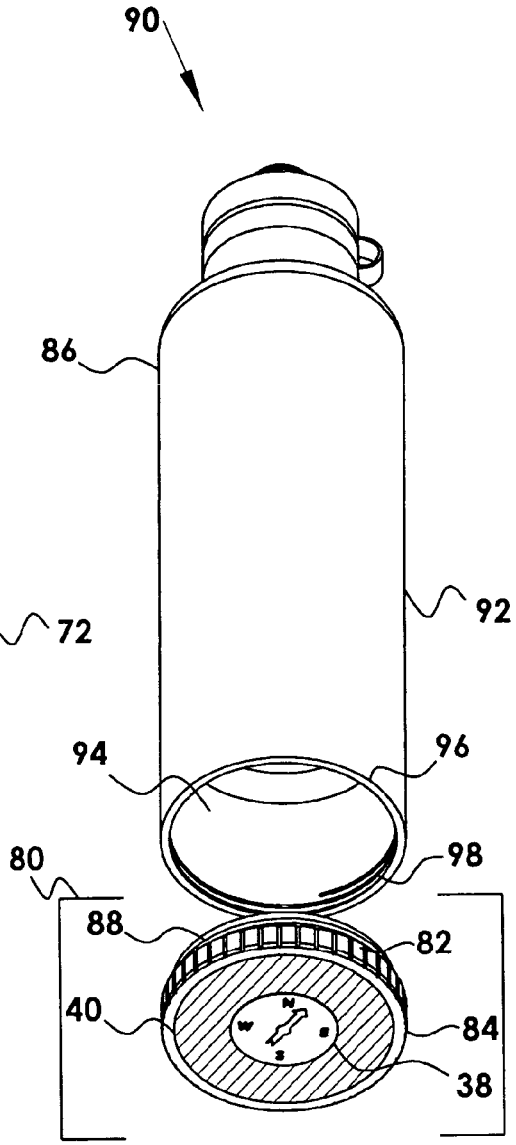
FIG. 8 Depicts an alternative embodiment of a multifunction hydration container accessory system having a molded auxiliary container and a screw-on cap having a direction indicator accessory and a safety reflector reflective material accessory.

FIG. 8 depicts a partially exploded perspective view of an alternative embodiment of the invention, where illustrated is a multifunction molded-canister hydration container accessory system 90 having a molded-canister accessory 92 integrated with a hydration container as a single unit, and having a molded-canister cavity 94 encapsulated by molded-canister walls 96 and a canister cap 80 as depicted in FIG. 7, wherein canister cap 80 has canister cap male threads 86 for inserting to molded-canister female threads 98 within molded-canister walls 96 for sealing molded-canister cavity 94, using means discussed with FIG. 7. Canister cap 80 is depicted having a canister cap housing 82, a canister cap front surface 84 for fixedly mounting a compass 38 and a safety signal reflective material 40. The molded-canister walls 96 have molded-canister female threads 98 for receiving canister cap male threads 88 to seal the molded-canister cavity 78, where the canister cap 80 is depicted as removed from the molded-canister cavity 94 and molded-canister female threads 98 for illustrative purposes.

Figure 9:
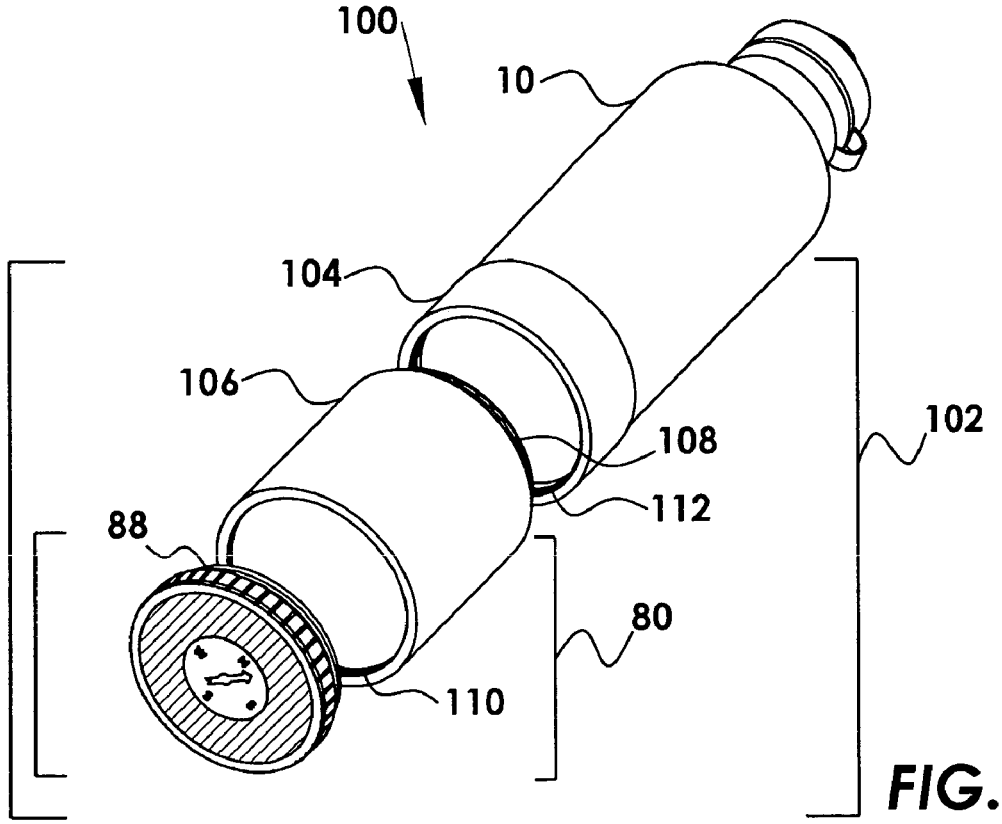
FIG. 9 Depicts an alternative embodiment of a multifunction hydration container accessory system having a mounted base, a screw-on auxiliary storage container module and a screw-on cap having a direction indicator accessory and a safety reflector reflective material accessory.

FIG. 9 depicts a partially exploded perspective view of an alternative embodiment of the invention, where shown is a multifunction modular storage hydration container accessory system 100 comprising a modular canister accessory 102 for fixedly attaching to a bicycle hydration container 10, where it is obvious the modular canister accessory 102 can be adapted to other hydration containers without departing from the spirit of the invention. The modular storage hydration container accessory system 102 enables variable storage capacity through stackable modules. The modular canister accessory 102 comprises a base housing 104 fixedly mounted to bicycle hydration container 10 using attaching means such as described in FIG.'S 4 and 5, a storage module 106 having a first end with male attachment threads 108 and a second end with female attachment threads 110, and canister cap 80 for sealing the storage module 106. Further depicted is base housing 104 having base housing female threads 112 for receiving storage module male threads 108 should the user desire cargo space, or for receiving canister cap male threads 88, as described with FIG. 7, when no storage is desired. It is obvious that a plurality of storage modules 106 can be stacked and combined for variable storage space.

Figure 10:
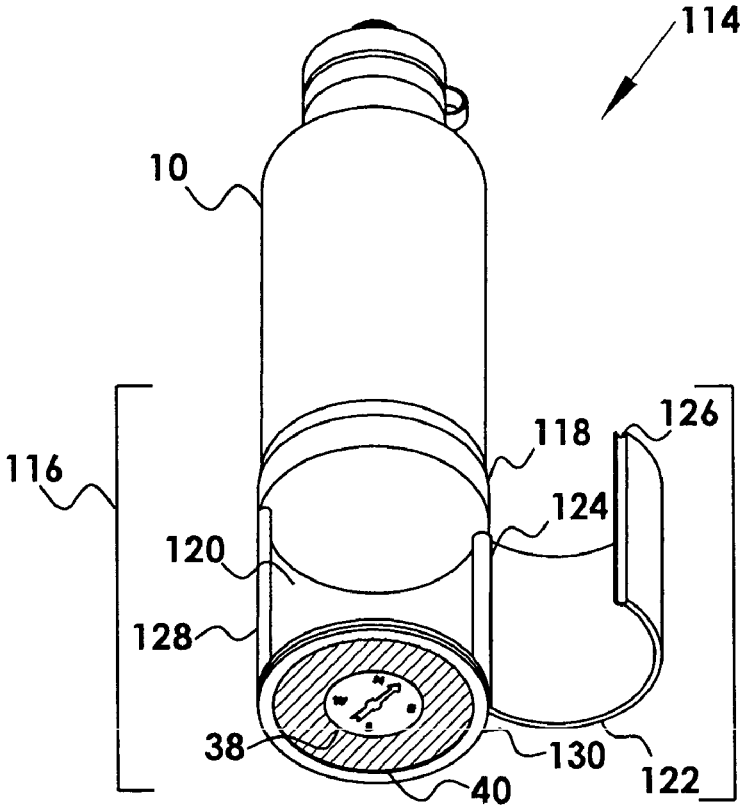
FIG. 10 Depicts an alternative embodiment of a multifunction hydration container accessory system having a hinged auxiliary storage container module accessory and a direction indicator accessory and a safety reflector reflective material accessory.

FIG. 10 depicts a perspective view of an alternative embodiment of the invention where shown is a multifunction compartment storage hydration container accessory system 114 having a compartment storage container accessory 116 fixedly attached to hydration container 10. Compartment storage container accessory 116 comprises compartment housing 118, compartment cavity 120, compartment door 122 pivotably attached to compartment housing 118 using compartment door hinge 124 to close about compartment cavity 120, where compartment door 122 has a latching means such as compartment door hook 126, attached to compartment door 122 for engaging compartment cavity latch 128 to operatively secure the compartment door 122 closed about the compartment cavity 120. The compartment storage container accessory 116 further comprising compass 38 and safety signal reflective material 40 fixedly attached to housing front surface 130.

Figure 11:
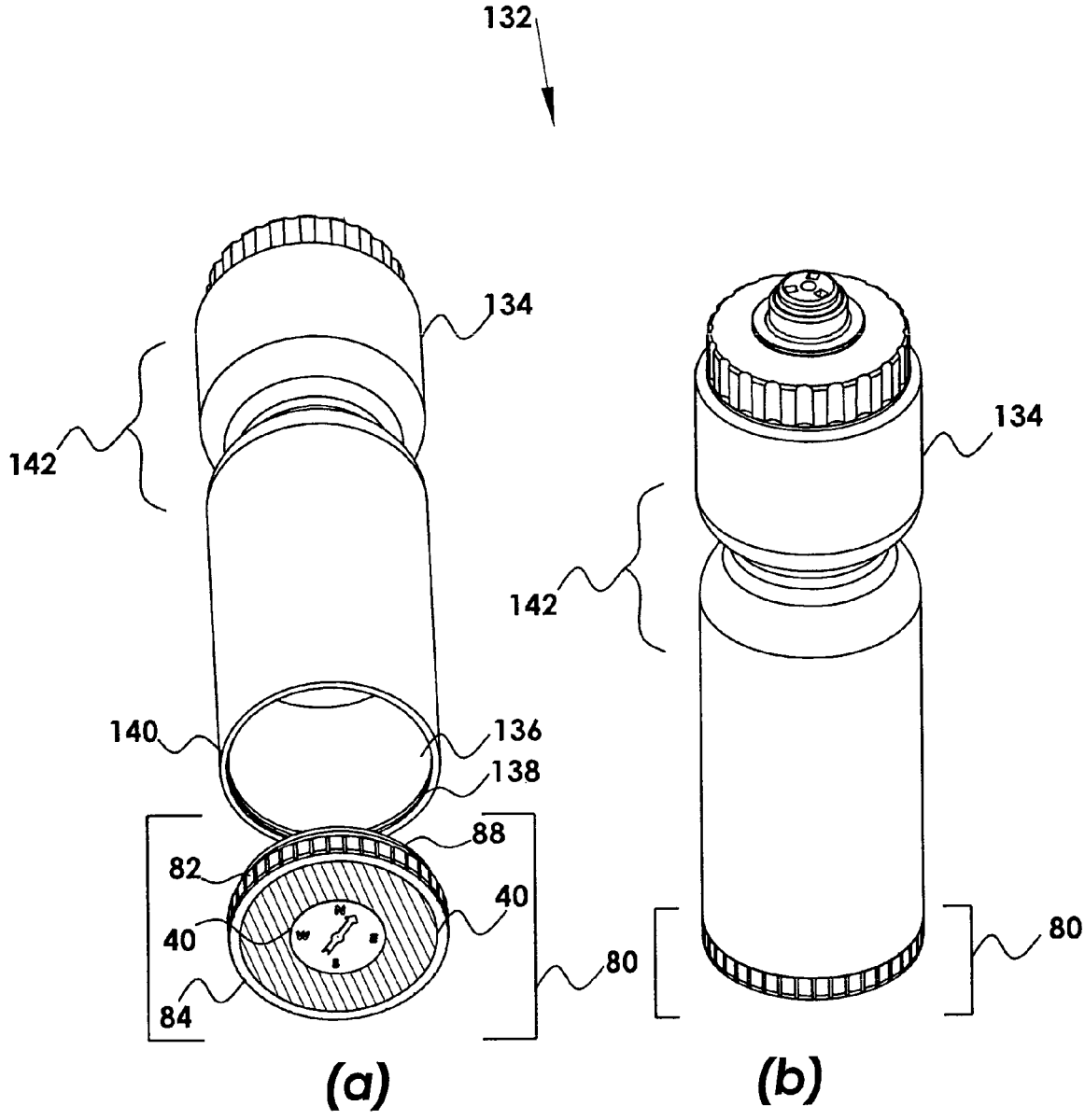
FIG. 11*a* and FIG. 11*b* depicts an alternative embodiment of a multifunction hydration container accessory system having a oversized hydration container with a mounting cage depression for inserting into a mounting cage typically used with bicycles.

FIG.'S 11*a* an 11*b* depict an alternative embodiment of the invention, where an oversized multifunction molded-canister bicycle hydration accessory system 132 is depicted, comprising an oversized bicycle hydration container 134 having a molded storage compartment 136 and a canister cap 80. FIG. 11*a* is a partially exploded view of the multifunction molded-canister bicycle hydration system 132, where depicted is the canister cap 80 removed from the oversized bicycle hydration container 134 to reveal the oversized canister cavity 136 and molded canister female threads 138 near the open end of molded canister walls 140 for receiving canister cap male threads 88 to seal the oversized canister cavity 136, where the canister cap 80 is depicted as removed from the canister cavity 136 and canister female threads 138 for illustrative purposes. Further depicted is multifunction molded-canister bicycle hydration system 132 having a mounting cage depression 142 for receiving a bicycle mounting cage (depicted in FIG.'S 12*a* and 12*b*) commonly found attached to bicycle frames (not shown). FIG. 11*b* depicts an assembled multifunction molded-canister bicycle hydration system 132.

Figure 12:
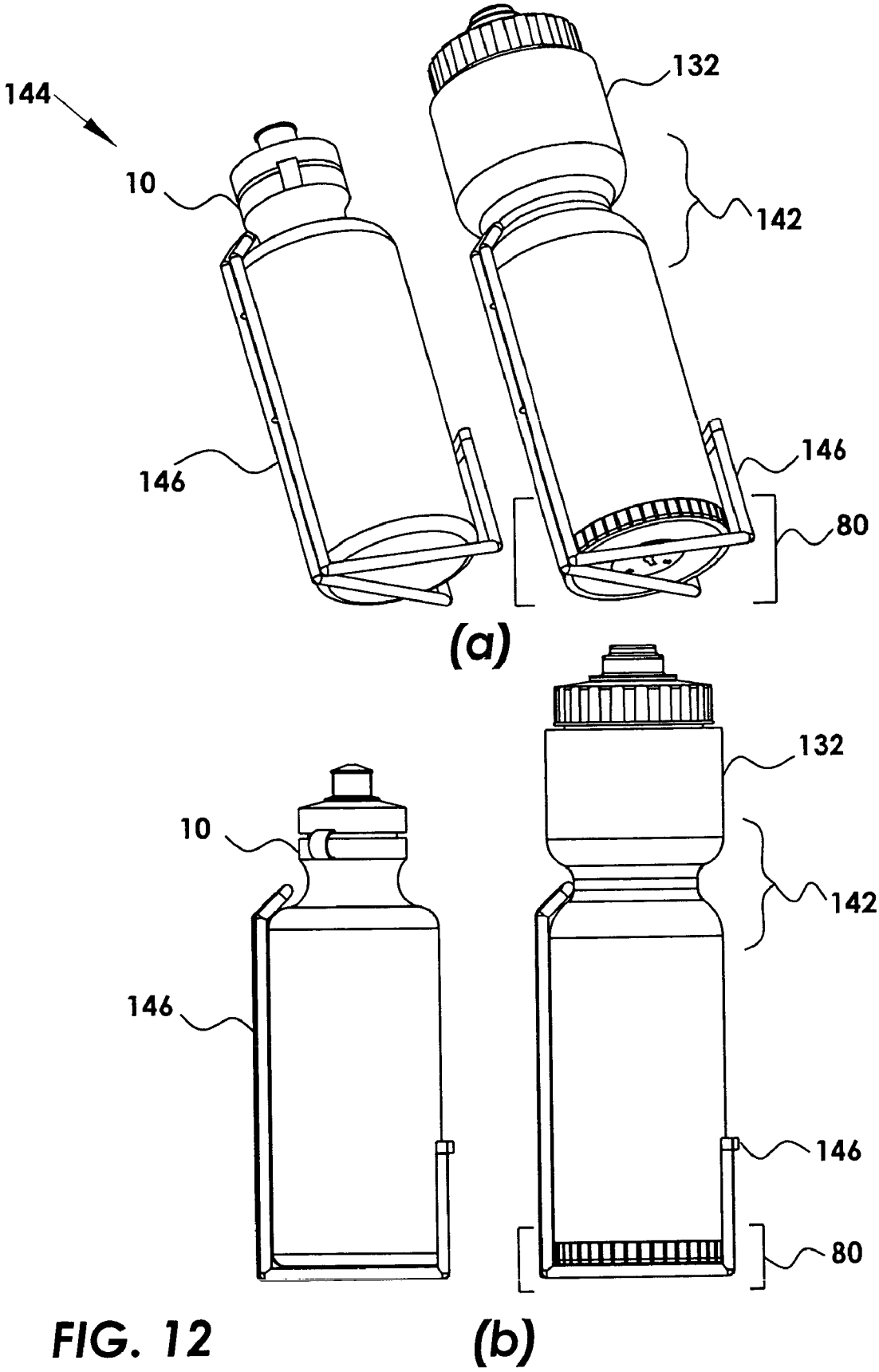
FIG. 12*a* and FIG. 12*b* Depict a comparison of a typical bicycle hydration container inserted into a hydration container mounting cage and an oversized multifunction molded-canister bicycle hydration system 128 inserted into a hydration container mounting cage.

Referring now to FIGS. 12*a* and 12*b*, where FIG. 12*a* depicts perspective view of a hydration container comparison 144 between a typical bicycle hydration container 10 inserted into a hydration container mounting cage 146, typically mounted to a bicycle frame (not shown), for holding the bicycle hydration container 10, and between an oversized multifunction molded-canister bicycle hydration system 132 inserted into a hydration container mounting cage 146, typically mounted to a bicycle frame (not shown), for holding the oversized multifunction molded-canister bicycle hydration system 144. FIG. 12*b* depicts a side view of the comparison between a typical bicycle hydration container 10 inserted into a hydration container mounting cage 146, typically mounted to a bicycle frame (not shown), for holding the bicycle hydration container 10, and between an oversized multifunction molded-canister bicycle hydration system 132 inserted into a hydration container mounting cage 146, typically mounted to a bicycle frame (not shown). Further depicted in FIG.'S 12*a* and 12*b* is the oversized multifunction molded-canister bicycle hydration system 132 having a mounting cage depression 142 with bicycle mounting cage 146 cradling the multifunction oversized molded-canister bicycle hydration system 132, where a typical bicycle hydration container 10 cradled by a hydration container mounting cage 146 for attaching to a bicycle frame (not shown) is presented for comparison purposes.

Obviously, many modifications and variations of the present invention are possible in light of the above teachings. It is therefore to be understood that, within the scope to the appended claims, the invention may be practiced otherwise than as specifically described.

What is claimed is:

1. A (multifunction) bicycle and hiking hydration container safety accessory system comprising:

a bicycle hydration container of generally cylindrical shape having a planar bottom surface with bottom edges and a bicycle container neck for frictionally fitting into a bicycle mounting cage and having a top for filling and dispensing hydration liquids; and a hiking hydration container of generally cylindrical shape having a planar surface with bottom edges and having a top for filling and dispensing hydration liquids; and an accessory housing of generally cylindrical shape having a first end for fixedly attaching to said hydration container planar bottom with bottom edges and having a second end for fixedly holding a (plurality of container accessories) compass and safety signal mirror.

2. The (multifunction) bicycle and hiking hydration container safety accessory system of claim 1 wherein said accessory system housing is fixedly attached to said bicycle and hiking hydration container using an adhesive bonding agent.

3. The (multifunction) hydration container safety accessory system of claim 1 wherein said housing is fixed to said hydration container using hook and pile interlock.

4. The (multifunction) bicycle and hiking hydration container safety accessory system of claim 1 wherein said accessory system housing is plastic welded to said hydration container for fixedly holding the accessory system.

5. The (multifunction) bicycle and hiking hydration container safety accessory system of claim 1 wherein said accessory system housing (front) second surface is suitable for fixedly holding a navigation indicator accessory.

6. The (multifunction) bicycle and hiking hydration container safety accessory system of claim 5 wherein said navigation indicator accessory is a compass.

7. The (multifunction) bicycle and hiking hydration container safety accessory system of claim 5 wherein said navigation indicator accessory is a global position system.

8. The (multifunction) bicycle and hiking hydration container safety accessory system of claim 1 wherein said accessory system housing has housing walls with female mounting threads for attaching an accessory cap having male threads for holding said (container) utility items (accessories).

9. The (multifunction) bicycle and hiking hydration container safety accessory system of claim 8 wherein said (container) accessory housing is a canister storage module of generally cylindrical shape having canister mounting threads for attaching to said accessory housing mounting threads.

10. The (multifunction) bicycle hydration container safety accessory system of claim 8 wherein said (container) accessory housing further comprises (is) a canister cap having a canister cap housing for holding mounting threads for attaching to said accessory housing mounting threads and a canister cap front surface for fixedly mounting utility items.

11. The container canister cap of claim 10 wherein said utility item is a viewable compass for use in navigation.

12. The container canister cap of claim 10 wherein said utility item is a signal reflective (material) mirror.

13. The container canister cap of claim 10 wherein said utility item is a safety road reflector for use when the reflector is hand-held for directing towards a light source.

14. The container canister cap of claim 10 wherein said utility item is a lighting source.

15. The (multifunction) bicycle and hiking hydration container safety accessory system of claim 1 wherein said housing has canister walls for creating a canister cavity.

16. The (multifunction) bicycle and hiking hydration container safety accessory system of claim 15 wherein said canister walls have threads for receiving threads of a canister cap and secure said canister cap thereto.

17. The (multifunction) bicycle and hiking hydration container safety accessory system of claim 1 wherein said hydration container has a molded-canister integrated with said hydration container to create a canister cavity.

18. The (multifunction) bicycle and hiking hydration container safety accessory system of claim 17 wherein said integrated molded canister has canister walls for holding threads to receive threads of a canister cap and secure said canister cap thereto.

19. The (multifunction) bicycle and hiking hydration container safety accessory system of claim 1 wherein said accessory system housing is a modular canister accessory having female mounting threads on a first end for mounting to said bicycle container housing having male threads, and having female threads on a second end for mounting to (and) a canister cap having male mounting threads on a first end and a second end for fixedly holding utility components.

20. The (multifunction) bicycle and hiking hydration container safety accessory system of claim 19 wherein said modular canister mounts to a plurality of other modular canisters to enable variable storage capacity.

21. The (multifunction) bicycle and hiking hydration container safety accessory system of claim 1 wherein said accessory is a compartment storage container accessory having a compartment cavity and a compartment door pivotably attached to said housing to close about said compartment cavity.

22. The compartment storage container accessory of claim 21 wherein said compartment door has a compartment door hook for operatively engaging a compartment cavity latch to close about said compartment cavity.

23. The compartment storage container accessory of claim 21 further comprises a compass and a safety signal reflective material fixedly attached to said housing second end.

24. The (multifunction) bicycle and hiking hydration container safety accessory system of claim 1 wherein said housing is an oversized multifunction molded-canister having a molded storage compartment molded to said hydration container and having threading near said storage compartment end for receiving a canister cap to close said molded storage compartment.

25. The oversized multifunction molded-canister of claim 24 wherein said molded-canister operatively fits into a bicycle hydration container mounting cage.

* * * * *